United States Patent [19]

Abbott

[11] 4,113,136

[45] Sep. 12, 1978

[54] TAMPER PROOF CONTAINER ASSEMBLY

[76] Inventor: Joseph L. Abbott, 2275 N. Cable, Apt. 184, Lima, Ohio 45087

[21] Appl. No.: 803,624

[22] Filed: Jun. 6, 1977

[51] Int. Cl.[2] ..... B65D 41/32

[52] U.S. Cl. ..... 220/276; 215/256

[58] Field of Search ..... 220/276, 307, 266; 215/256, 254

[56] References Cited

U.S. PATENT DOCUMENTS

| | | | |
|---|---|---|---|
| 2,751,102 | 6/1956 | Kihm | 215/256 |
| 3,262,602 | 7/1966 | McConnell | 220/307 |
| 3,415,404 | 12/1968 | Robinson | 215/256 |
| 3,858,748 | 1/1975 | Marco | 220/276 |
| 3,930,593 | 1/1976 | Ragettli | 220/276 |
| 3,981,412 | 9/1976 | Asmus | 215/256 |

*Primary Examiner*—Ro E. Hart

*Attorney, Agent, or Firm*—Meyer, Tilberry & Body

[57] ABSTRACT

A reclosable container assembly is disclosed comprising a container body having an open end and a cover for closing the open end. The cover has a wall portion extending into the open end of the container body and interengaging therewith to provide a snap-fit therebetween. The cover has a peripheral flange including a portion extending radially outwardly across the open end of the container body and terminating in a peripheral skirt. The underside of the radially extending flange portion is provided with a peripherally continuous V-shaped recess providing a line of weakness along which the material of the cover fractures and tears in response to an attempt to displace the cover flange in the direction to separate the cover from the container body. The material along the line of weakness fractures in response to a displacement force less than that required to disengage the snap-fit between the container body and cover, and provides a visual indication that the container assembly has been tampered with.

31 Claims, 6 Drawing Figures

TAMPER PROOF CONTAINER ASSEMBLY

This invention relates to the art of containers and, more particularly, to an improved tamper proof container body and cover assembly.

In connection with the packaging of products in general and especially certain food products such as cottage cheese, yogert and the like for sale in commercial outlets such as grocery stores, it is desirable to provide a container body and cover assembly which enables the purchaser to remove a quantity of the packaged food and reclose the container so that the food can be stored for subsequent consumption. Many container assembly structures have been developed for this purpose and function well insofar as the intended opening, reclosing and storage functions are concerned. However, problems independent of these functions exist in connection with the display and sale of foods packaged in such container assemblies. In this respect, potential customers and/or inconsiderate and unscrupulous shoppers will partially or fully open such a container assembly for the purpose of inspecting, sampling and/or consuming a considerable quantity or all of the contents in the container. These actions may take place either at the location of the container in the store or while the customer is pushing a shopping cart around the store and loading the cart. If the contents of the container do not appeal to the customer, or following partial or full consumption of the contents of the container, the customer will then reapply the cover and replace the container assembly on the store shelf. If the contents have only been tested or partially consumed, an unwary customer may purchase the product which has been tampered with without realizing this fact. While a container from which the contents have been completely removed would more than likely be detectable by the weight thereof and would not be purchased by a customer, the loss is nonetheless passed onto customers by increased prices enabling the store to overcome such losses. Accordingly, it will be appreciated that it is desirable to provide a container assembly which minimizes or eliminates the tampering problem.

Previous efforts to provide a tamper proof reclosable container assembly have required the use of additional materials and/or additional manufacturing steps and/or the use of special tools or processes, all of which have resulted in an increase in the per unit cost of such container assemblies. For example, taping arrangements have been provided between the container body and cover requiring removal to achieve access to the cover for removal thereof from the container body. Thus, if the tape is missing a shopper is put on notice that the package has been tampered with. However, such tape is a cost item and, additionally, the food packager is required to provide machinery for application of the tape after the container has been filled. This is of course an additional cost item, whereby the per unit cost of the end product is increased.

Other efforts to produce a tamper proof container assembly have included provisions for welding portions of the cover and container body together either with or without score lines such that a portion of the cover ruptures at the welds and/or along the score lines to visibly indicate that the package has been tampered with. These arrangements, some of which are discussed more fully hereinafter, are undesirable in that they increase the cost of production or packaging by requiring the packager to provide equipment for welding and, more importantly, because they can cause container body or cover failure by tearing, thus destroying the reclosing capability. In other words, the desired releasable closure function is not reliable. Moreover, welding requires a special body configuration to provide cover and body portions juxtaposed for welding, and use of materials compatible for welding, whereby such a tamper proof arrangement is limited in application and expensive.

In accordance with the present invention, the foregoing and other disadvantages encounterd in connection with previous efforts to provide a tamper proof container assembly are minimized or overcome. More particularly, the tamper proof arrangement according to the present invention is applicable to any reclosable container assembly in which the cover has a flange portion, and enables the use of a variety of materials and combinations of materials for the container body and cover. There is no interconnection between the cover and container body other than that provided to enable a snap-fit therebetween for reclosure purposes and, therefore, the present tamper proof arrangement is applicable to a wide variety of container body and cover structures. Further, the tamper proof arrangement is incorporated in the cover at the time of manufacture thereof, whereby there are no requirements for the packager beyond filling the container body and applying the cover in the usual manner. Still further, tamper protection is obtained in accordance with the present invention by providing a line of weakness peripherally of the cover flange such as by a score line or the like, preferably in the underside of a radially extending portion of the flange. Such a line of weakness can be provided in conjunction with the production of the cover by simple tooling which minimizes additional cost with respect to the container assembly.

In accordance with another aspect of the present invention, the freedom of interconnection between the cover flange and container body provides for any peripheral portion of the cover flange to be displaced in the direction to open the container in a manner whereby the material in the area of the line of weakness at the given peripheral portion of the cover flange is stressed along a line perpendicular to the line of weakness, thus maximizing the efficient application of force and the resulting stress to cause the cover material to fracture at the line of weakness. The line of weakness provides for the material to fracture under an opening force less than that required to displace the snap-fit interengagement between the cover and container body. Additionally, the freedom of connection between the cover flange and container body eliminates any distortion of the container body and resistance to flange displacement in response to an effort to achieve cover removal. These relationships also avoid the application of opening force in a direction tending to cause the cover material to tear along a line across the body of the cover and thus increases reliability in connection with achieving the tamper protection desired. It will be appreciated, therefore, that a person grasping the cover flange and pulling thereon in the direction to separate the cover from the container body will separate the outer portion of the cover flange from the remaining portion of the cover at least a certain distance around the periphery of the cover, thus providing a visual indication that the package has been tampered with. If the entire outer portion of the flange is so removed about the periphery of the cover, the tampering is even more obvious. Advantageously, if a shopper should break the flange at one location about the periphery and then attempt to open the container at another location about the periphery, the result is the application of force perpendicular to the line of weakness as described above and thus fracture of the flange at the second location. Thus, the disrespectful or unscrupulous shopper is deterred from continuing to attempt to open the container.

It is also desirable in connection with tamper proof container assemblies to facilitate opening thereof by a bonafide purchaser, and the arrangement in accordance with the present invention advantageously serves this purpose. In this respect, the purchaser can readily sever the outer portion of the flange from the remaining portion of the container by applying an opening force in the manner described hereinabove. Thereafter, the cover can be removed by grasping the remaining inner portion of the flange and pulling outwardly of the open end of the container to achieve separation of the cover from its snap-fit interengagement with the container body. Thus, the purchaser is not confronted with the sometimes difficult and time consuming operation of removing tape. Further, the purchaser is not faced with the possibility of tearing the cover or container body and thus destroying further usefulness of the container assembly such as can happen with welded cover and container body assemblies. In this respect, such containers are often retained by a housewife after consumption of the product for such purposes as storage of left over foods in a refrigerator, small decorative planters, and storage receptacles for odds and ends such as pencils, erasers, coins and the like. By avoiding any connection between the cover and container body which detracts from the aesthetic value of the container body, the availability of the container body for such household uses enhances salability of the product therein.

The most pertinent prior art of which applicant is aware with regard to reclosable containers of the foregoing character having protection against tampering is U.S. Pat. No. 4,006,893 to Thiel et al. issued Feb. 8, 1977. The Thiel et al. patent discloses numerous arrangements wherein a planar cover flange is welded to an underlying planar container body flange, either with or without tear lines defined by perforations or the like in the cover flange. In the embodiments disclosing welds and tear lines, the welds are disposed radially outwardly of the tear lines and either provide for the corresponding portion of the cover to remain attached to the container body flange, or for the welds to be detachable so that a cover removal force causes the cover and body flange to rupture at the welds and then the score line so that the outer portion of the cover flange is removed. All of these arrangements require a radially flat container body flange to enable the welding of the cover flange thereto and materials compatible for welding. Applicant's arrangement is both structurally and functionally distinct from the arrangements disclosed in the Thiel et al. patent. In this respect, the flange portion of applicant's container cover is free of any connection with the container body thus avoiding a special container body configuration at the open end and avoiding the requirement for special equipment to bond the cover and body components, and avoiding the necessity for the packager to provide such special equipment in connection with filling and closing the container.

Additionally, in applying an opening force to the cover flange of the arrangements shown in the Thiel et al. patent, both the cover flange and body flange are distorted in the direction of force application. This distortion stresses the material of the cover flange and container body flange, and this promotes the possibility that the ensuing rupture of the welds will result in tearing of the cover and/or body material due to the weakening thereof in the area of the welds and due to the fragilable nature of the material and the acceleration of the force which results upon a sudden release of the bond between the body and cover. Moreover, the positions of the bonds radially outwardly of the tear line provides for the force applied to the tear line to be directed laterally toward the tear line as opposed to perpendicular thereto in accordance with the present invention. In this respect, as the welds break circumferentially of the cover flange from the point of force application, there is a holding force between the cover flange and body flange which resists bending of the flange relative to the remainder of the cover. In other words, the welds provide for the force of separation to in affect be a prying action in which the body and cover flanges are displaced relative to one another generally in the direction perpendicular to the plane thereof. Upon initial separation of the welds at the point of opening force application, little or no force is applied to the tear line to stress the material in the area thereof, and as the breaking of welds progresses circumferentially the force application is directed toward the tear line at an angle as opposed to perpendicular thereto. Accordingly, there is an inefficient force application and, additionally, the possibility that this undesirable direction of force application will stress the material of the cover such that the latter will tear across the body of the cover as opposed to along the tear line. Further, the welds cause the container body flange to be distorted during application of an opening force and this, together with rupture of the welds, can cause the container body to be torn. Still further, there is no guarantee that the welds will fail as desired and this further adds to the problems of unreliability and inefficiency.

It is very important in accordance with the present invention that the cover flange be free of connection with the container body. This guarantees that an opening force applied to any peripheral portion of the flange radially outwardly of the line of weakness will displace the flange in the direction of the opening force so that the flange pivots at the line of weakness to stress the material in the area of the line of weakness in the direction perpendicular to the line. This immediately directly stresses the material of the cover in the area of the line of weakness and maximizes the stress to assure fracture of the material along the line as opposed to across the line and into the body of the cover. Additionally, this force application is independent of any distortion of the container body thus avoiding any possible damage thereto and avoiding any resistance to or interference with the desired fracturing of the cover material.

It is accordingly an outstanding object of the present invention to provide an improved reclosable container assembly having an arrangement to deter unintended or unauthorized initial removal of the cover from the container body.

Another object is the provision of a container assembly of the foregoing character in which the cover component includes a peripheral flange having a line of weakness thereabout which provides for the portion of the flange outwardly of the line of weakness to be severable from the remainder of the cover upon the application of a force thereto in the direction of cover removal less than that required to separate the cover from the container body.

Yet another object is the provision of a container assembly of the foregoing character in which displacement of the outer portion of the flange in the opening direction stresses the cover material in the area of the line of weakness along a line perpendicular to the line of weakness.

A further object is the provision of a container assembly of the foregoing character in which the line of weakness is provided by thinning the flange material in the direction from the underside toward the outside of a radially extending portion of the flange so as to maximize stressing of the material for fracturing and the efficient application of force to fracture the material in the area of the line of weakness in response to displacement of the flange in the opening direction.

Yet a further object is the provision of a container assembly of the foregoing character in which the provision for achieving deterrence against unintentional or unauthorized initial opening of the container is achieved more economically than heretofore possible.

Still a further object is the provision of a container assembly of the foregoing character in which the protection against unauthorized or unintended initial opening of the container is more reliable and more efficient than arrangements heretofore provided.

The foregoing objects, and others, will in part be obvious and in part pointed out more fully hereinafter in conjunction with the written description of the accompanying drawings showing a preferred embodiment of the invention and in which.

Figure 1:
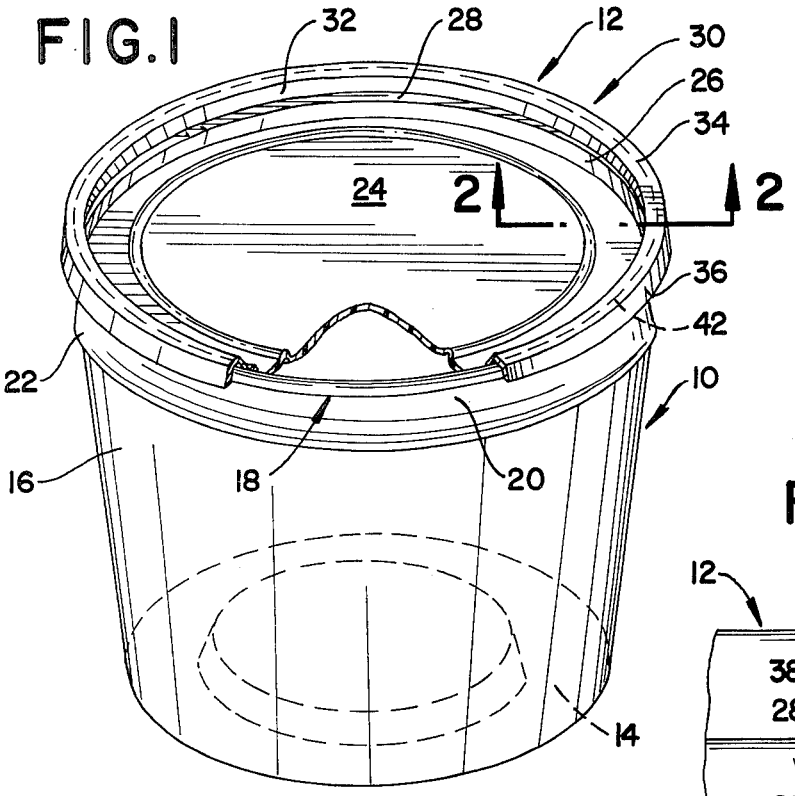
FIG. 1 is a perspective view of a reclosable container assembly in accordance with the present invention.
Figure 2:
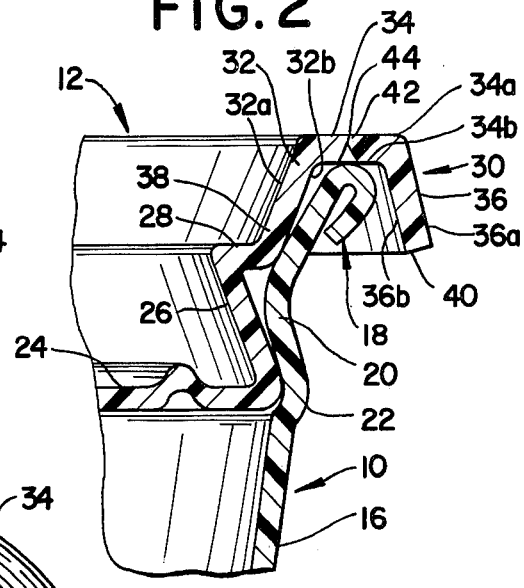
FIG. 2 is a sectional elevation view of a portion of the container assembly taken along line 2—2 in FIG. 1.

Referring now in greater detail to the drawings wherein the showings are for the purpose of illustrating a preferred embodiment of the invention only and not for the purpose of limiting the invention, FIGS. 1 and 2 illustrate a reclosable container assembly comprising a container body 10 and a cover 12 closing the open upper end of the container body. In the embodiment illustrated, container body 10 is produced from polystyrene and includes a circular bottom wall 14 and a sidewall 16 extending peripherally of and upwardly from the bottom wall. Sidewall 16 is circular in cross section, and the upper marginal edge of the sidewall is turned outwardly and downwardly to form a peripheral bead 18 extending about the circular open upper end of the container body. A portion of wall 16 axially inwardly from the open end of the container body is provided with ridges 20 and 22 respectively projecting radially inwardly and outwardly of the container body and each extending peripherally thereof to provide a container body wall portion interengaging with cover 12 in the manner and for the purpose set forth hereinafter.

Cover 12 is of circular configuration and includes a central body or panel portion 24 peripherally bounded by a wall 26 extending upwardly and radially inwardly of the cover and a wall 28 extending radially outwardly from the upper end of wall 26. As seen in FIG. 2, the diameter of the outer surface of cover 12 at the lower end of wall 26 is greater than the smallest diameter measured across the inner surface of container body ridge 20. This diametrical relationship provides an interengaging detent arrangement between the container body and cover which enables the cover to be removably and replaceably interengaged with the container body. Further, walls 26 and 28 and ridge 20 are axially and radially dimensioned to enhance frictional interengagement and a sealing relationship between the container body and cover, and ridge 22 is located to limit displacement of the cover axially inwardly of the container body during an assembly operation. While it is essential in accordance with the present invention that the container body and cover have an arrangement providing frictional interengagement therebetween requiring a given force on the periphery of the cover in the direction axially outwardly of the open end of the container body to achieve cover removal, the particular structures of the interengaging portions of the cover and container body are not important. Accordingly, it will be appreciated that the structures shown and described herein are merely illustrative of one possible arrangement for achieving the cover retention function.

Cover 12 further includes a peripheral flange 30 which, in the embodiment shown, includes a first flange portion 32 extending upwardly from the radial outer end of wall 28, a second flange portion 34 extending radially outwardly from the upper end of flange portion 32 and across bead 18 of the container body, and a third flange portion 36 in the form of a skirt extending downwardly from the radially outer end of flange portion 34. Flange portion 32 has a lower end 38 at the juncture thereof with wall portion 28 and defining the inner end of flange 30, and skirt 36 has a terminal edge 40 defining the outer end of flange 30. Each of the flange portions 32, 34 and 36 has a corresponding outer side 32*a*, 34*a* and 36*a* and a corresponding underside 32*b*, 34*b* and 36*b*. The undersides of the flange portions may or may not engage outer surface portions of bead 18 of the container body, but in any event it is important in accordance with the present invention that flange 30 is free of any connection with or attachment to the container body such as might be defined by an adhesive bond, heat seal, weld, or the like.

In accordance with the present invention, flange 30 is provided with a peripheral line of weakness 42 which, as set forth more fully hereinafter, provides for the flange to fracture and tear along the line of weakness in response to displacement of the flange axially outwardly with respect to the open end of the container body. In the preferred embodiment, the line of weakness 42 is provided by means of a peripherally continuous V-shaped recess 44 in underside 34*b* of radial flange portion 34 and which recess is circular and coaxial with respect to the axis of the container body and thus parallel to the contour of the open end of the container body. It will be appreciated that scoring of the flange in this manner reduces the material thickness and weakens the material axially across flange portion 34 between the apex of the V and outer side 34*a*, thus to define line of weakness 42 in the flange. Preferably, the line of weakness is located in flange 30 radially between the juncture of flange portion 34 with flange portions 32 and 36.

Figure 3:
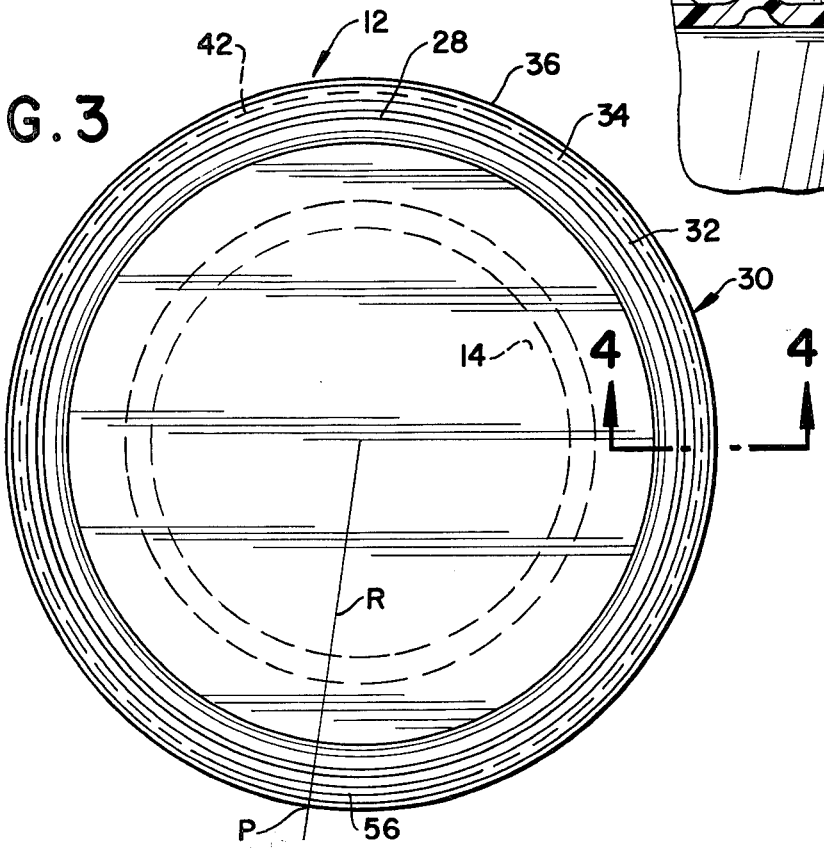
FIG. 3 is a plan view of the cover component of the assembly.
Figure 4:
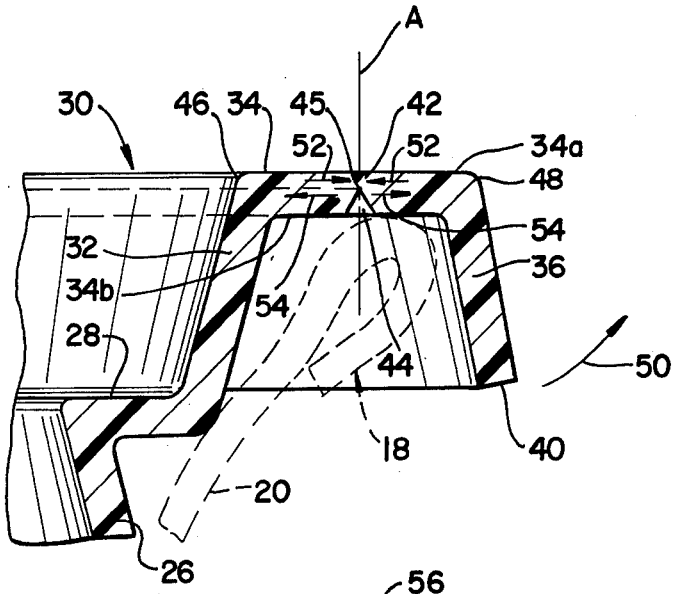
FIG. 4 is an enlarged sectional elevation view of a portion of the cover taken along line 4—4 in FIG. 3.
Figure 5:
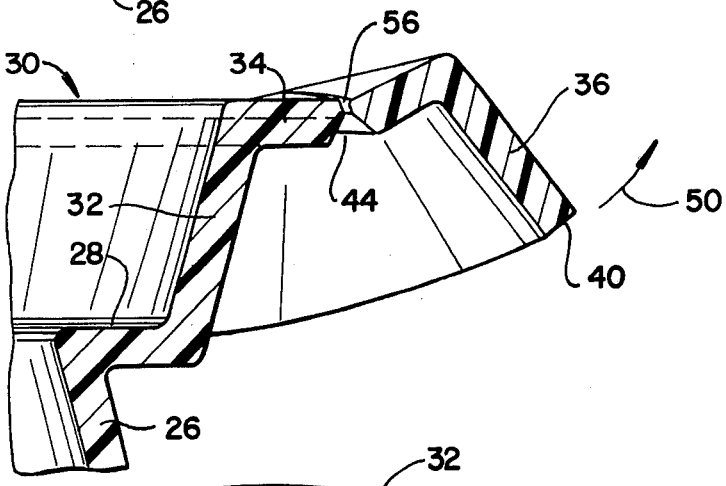
FIG. 5 is a sectional elevation view similar to FIG. 4 and illustrating opening displacement and fracture of the cover flange; and, FIG. 6 is a perspective view of the container body and cover assembly showing fracture and partial tearing of the cover flange circumferentially of the assembly.

The manner in which flange 30 fractures in response to an effort to initially open the container assembly will be best understood with reference to FIGS. 3–6 of the drawing. Referring first to FIG. 4, radial flange portion 34 has radially inner and outer edges 46 and 48, respectively. It will be appreciated that cover 12 would normally be removed from the container body by applying a force to terminal edge 40 of skirt 36 in a direction generally radially and axially outwardly with respect to the open end of the container body as indicated by arrow 50. In the absence of recess 44, such an opening force applied at any given peripheral area of the cover would tend to bend radial flange portion 34 about a circumferential line of bending located between inner and outer edges 46 and 48 thereof, the location of which circumferential line is designated in FIG. 4 by the reference axis A. The circumferential line of bending represents the location between inner and outer edges 46 and 48 of flange portion 34 at which maximum stress would be applied to the material of the flange portion 34 in response to displacement of flange portion 36 in the direction of arrow 50. Accordingly, this is the most preferable location for recess 44 and, as shown in FIG. 4, recess 44 is radially positioned for apex 45 of the recess to intersect axis A and thus underlie the circumferential line of bending. Again in the absence of recess 44, displacement of skirt 36 in the direction of arrow 50 and the application of a given force in the latter direction provides for the lower end of the cover wall portion 26 to disengage from beneath ridge 20 of the container body enabling removal of the cover.

In accordance with the present invention, recess 44 prevents cover removal in the above manner by reducing the material thickness of flange portion 34 along axis A, thereby weakening the material and reducing the force otherwise required to fracture flange portion 34 by bending the material thereof. More particularly, upon displacement of skirt 36 in the direction of arrow 50 the material of radial flange portion 34 adjacent outer side **34*a* thereof is radially compressed as indicated by arrows 52 and the material adjacent apex 45 of recess 44 is tensioned as indicated by arrows 54. It will be appreciated that apex 45 of recess 44 defines a stress riser promoting material fracture in the direction upwardly from the apex in response to displacement of the converging walls of the recess away from one another in a manner tending to increase the angle therebetween. Therefore, in response to displacement of skirt 36 in the direction of arrow 50 the walls of recess 44 are so displaced relative to one another, whereby flange portion 34 fractures or breaks as indicated by numeral 56 in FIGS. 3 and 5. It will be appreciated of course that the depth of recess 44 in the direction from underside 34*b* toward outer side 34*a* is sufficient for flange portion 34 to fracture under a force of displacement in the direction of arrow 50 less than the force required to disengage wall portion 26 of the cover from beneath ridge 20** of the container body.

Fracturing of radial flange portion 34 in the foregoing manner is further enhanced by the fact that the compressive and tensile forces applied in the directions of arrows 52 and 54 are applied directly along a radial line R from the peripheral point of force application P and thus perpendicular to the line of weakness, as illustrated in FIG. 3. This line of force application results from the absence of any fastening connection between the cover flange and body portion of the container and provides for maximizing compressive and tensile forces applied at axis A in response to displacement of skirt 36 in the direction of arrow 50 under a given force.

Figure 6:
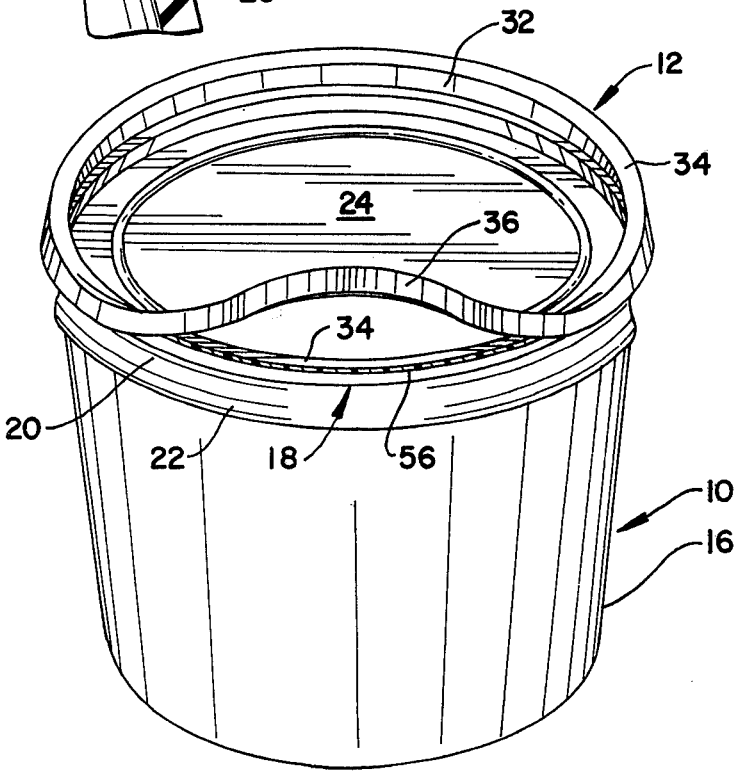

To remove cover 12 from body portion 10 it becomes necessary to sever the radially outer end of flange portion 34 and skirt 36 from the remainder of the cover, or at least to sever a substantial circumferential length thereof to enable movement of the fingers therebeneath so as to grasp the inner end of flange portion 34 and flange portion 32 in order to apply the force necessary to disengage the cover from the container body. Should a customer in a store attempt to open the container assembly causing the flange to fracture as described above, the customer may or may not continue to apply an upward force on the outer end of the flange in an effort to remove the cover. Should the customer do so, the outer end of flange portion 34 and skirt 36 will in effect be circumferentially peeled away from the remainder of the cover, as illustrated in FIG. 6. A continued upward pull on skirt 36 will of course result in complete separation of the outer end of flange portion 34 and skirt 36 from the remainder of the cover. In any event, a fracture of the flange along score line 42 with either partial or complete removal of the outer end of flange portion 34 and skirt 36 provides a visual indication that the container assembly has been tampered with. At the same time, fracture of the flange along the score line and complete severance of the outer end of flange portion 34 and skirt 36 from the remainder of the cover can be achieved quickly and simply with minimal physical effort, whereby the purchaser of the container assembly can readily gain access to the contents thereof.

The location of the circumferential line of bending represented by axis A and thus the location of recess 44 radially between inner and outer edges 46 and 48 of flange portion 34 can vary dependent on several factors including the type of material, the thickness of the material and the dimension of flange portion 34 between edges 46 and 48. Further, it will be appreciated that the depth of recess 44 can be varied to provide for fracture to occur in response to any given force of displacement against skirt 36. It is only necessary that such displacement force be less than that required to achieve disengagements between the cover and body portion and thus cover removal. As an example of the dimensional relationships for achieving the desired fracturing of the flange in the preferred embodiment herein illustrated, the cover is made of polystyrene and radial flange 34 has a radial dimension of about 0.150 inch between edges 46 and 48, and an axial thickness of about 0.017 to 0.019 inch between sides **34*a* and 34*b*. Recess 44 has an angle of 60° between the converging walls thereof and a depth in the direction from underside 34*b* which leaves a thickness of material between apex 45 and outer side 34*a* of about 0.006 to 0.010 inch. Further, reference axis A for the recess is located centrally between inner and outer edges 46 and 48 of flange portion 34**.

While considerable emphasis has been placed herein on a specific cover structure and the preferred score line configuration and location in the cover flange, it will be appreciated that many modifications can be made in the disclosed embodiment without departing from the principles of the present invention. In this respect, for example, the line of weakness providing for severance of a portion of the flange from the remainder of the cover can be located other than radially within flange portion 34 or on the line of bending of the radial flange portion as described herein. Accordingly, it will be appreciated for example that the line of weakness could be provided in skirt 36 or flange portion 32. While the latter location could make removal of the cover more cumbersome after severance of the flange along the line of weakness, neither location would prevent the primary function of fracture or removal of a portion of the flange to indicate tampering. Likewise, it will be appreciated that the line of weakness can be defined by a recess having a cross-sectional contour other than that of a V and can be defined by other arrangements providing a thinning or weakening of the material of the cover along a peripheral line thereabout. With respect to recesses, a series of circumferentially spaced recesses as opposed to a preferred single, circumferentially continuous recess could be employed. Moreover, a circumferentially continuous or interrupted recess arrangement could be provided in the outer side of the cover flange as opposed to the underside. With any of the foregoing modifications, it remains that the material of the flange is stressed at the line of weakness in the direction perpendicular to the line of weakness to optimize fracturing of the flange and severance of the portion of the flange radially outwardly of the line of weakness from the remainder of the cover. With regard to the structural configuration of the flange, it will be appreciated that the radial portion of the flange could have an arcuate contour in cross section as opposed to the flat contour herein illustrated. It will be further appreciated that while skirt 36 advantageously provides a convenient member for obtaining leverage with respect to displacement of the flange to achieve fracturing along the line of weakness, the skirt portion is not essential and the cover flange could terminate in a radially outwardly extending portion such as would be defined in the embodiment disclosed by eliminating skirt 36, and in which case the outer edge of flange portion 34 would define the outer end of flange 30. Still further, while the container body and cover are described as being formed of polystyrene, they can be produced from plastic materials other than polystyrene and from materials other than plastics, such as paper and metal foil, and from laminates of these materials. It will be appreciated too that the container body and cover can have a contour other than the circular contour herein described. In this respect, the body and cover could be ovular, square or of other polygonal peripheral contour.

As many possible embodiments of the present invention can be made, and as many changes can be made in the embodiment herein illustrated and described, it is to be distinctly understood that the foregoing descriptive matter is to be interpreted merely as illustrative of the present invention and not as a limitation.

Having thus described the invention, it is claimed:

1. A reclosable container assembly comprising a container body having an open end, and a cover for closing said open end, said cover having wall means extending into said open end of said body, said body and said wall means having interengaging means providing a snap-fit therebetween releaseably holding said cover in place with respect to said open end of said body, said cover having peripheral flange means including a flange portion extending radially outwardly with respect to said body at said open end thereof, said flange means further including an outer end, means providing a peripheral line of weakness in said flange means spaced from said outer end, said flange means being independent of connection with said container body whereby any given peripheral portion of said flange means between said line of weakness and said outer end is free for pivotal displacement in the direction axially outwardly of said open end of said container body to stress the material of said cover at said line of weakness in the direction perpendicular to said line of weakness from said given peripheral portion of said flange means, said means providing said line of weakness providing for the material of said cover to rupture at said line of weakness in response to said pivotal displacement and under a force of displacement less than that required to release said cover from said container body.

2. The container assembly according to claim 1, wherein said flange means has under and outer sides with respect to said container body, said line of weakness being provided by recess means extending into said flange means from said underside.

3. The container assembly according to claim 2, wherein said recess means is a peripherally continuous V-shaped recess.

4. The container assembly according to claim 3, wherein said V-shaped recess is parallel to the peripheral contour of said open end of said container body.

5. The container assembly according to claim 4, wherein said V-shaped recess has an angle of about 60° between the converging walls thereof.

6. The container assembly according to claim 2, wherein said recess means is in said radially extending flange portion.

7. The container assembly according to claim 6, wherein said recess means is a peripherally continuous V-shaped recess.

8. The container assembly according to claim 7, wherein said V-shaped recess is parallel to the peripheral contour of said open end of said container body.

9. The container assembly according to claim 8, wherein said radially extending flange portion has inner and outer edges, said V-shaped recess being located generally centrally between said inner and outer edges.

10. The container assembly according to claim 9, wherein said V-shaped recess has an angle of about 60° between the converging walls thereof.

11. The container assembly according to claim 7, wherein said radially extending flange portion has inner and outer edges, said V-shaped recess being located generally centrally between said inner and outer edges.

12. The container assembly according to claim 1, wherein said line of weakness is in said radially outwardly extending flange portion.

13. The container assembly according to claim 12, wherein said radially extending flange portion has radially inner and outer edges, said line of weakness being located generally centrally between said inner and outer edges.

14. The container assembly according to claim 12, wherein said line of weakness is provided by a peripherally continuous recess in said radially outwardly extending flange portion.

15. The container assembly according to claim 12, wherein said radially outwardly extending flange portion has outer and under sides with respect to said open end of said container body, said means providing said line of weakness being in said underside.

16. The container assembly according to claim 15, wherein said means providing said line of weakness is recess means extending into said radially extending flange portion from said underside.

17. The container assembly according to claim 16, wherein said recess means is V-shaped recess means in said underside.

18. The container assembly according to claim 17, wherein said radially extending flange portion has radially inner and outer edges, said V-shaped recess means being located generally centrally between said inner and outer edges.

19. The container assembly according to claim 17, wherein said V-shaped recess means is a peripherally continuous recess parallel to the peripheral contour of said open end of said container body.

20. The container assembly according to claim 19, wherein said radially extending flange portion has radially inner and outer edges, said recess being located generally centrally between said inner and outer edges.

21. The container assembly according to claim 1, wherein said peripheral line of weakness is parallel to the peripheral contour of said open end of said container body.

22. The container assembly according to claim 21, wherein said line of weakness is in said radially outwardly extending flange portion.

23. The container assembly according to claim 22, wherein said radially extending flange portion has outer and undersides, said means providing said line of weakness being recess means extending into said radially extending flange portion from said underside.

24. The container assembly according to claim 23, wherein said recess means is a peripherally continuous V-shaped recess.

25. The container assembly according to claim 24, wherein said V-shaped recess has an angle of about 60° between the converging walls thereof.

26. The container assembly according to claim 25, wherein said radially extending flange portion has a radial width and said recess is located generally centrally of said radial width.

27. A reclosable container assembly comprising a container body having a circular open end and a peripheral edge about said open end, and a circular cover for closing said open end, said cover having a wall portion extending into said open end of said body, said body and said wall portion having interengaging means providing a snap-fit therebetween releasably holding said cover in place with respect to said open end of said body, said cover having peripheral flange means including a flange portion extending radially outwardly over said peripheral edge and having radially inner and outer edges and a skirt portion depending from said radially outer edge in radially spaced relationship with respect to said container body, said skirt portion having a terminal edge axially spaced from said radially extending flange portion, said radially extending flange portion having outer and under sides with respect to said peripheral edge at said open end of said container body, recess means extending into said radially extending flange portion from said underside toward said outer side providing a peripheral line of weakness in said radially extending flange portion, said flange means being independent of connection with said container body, whereby any given peripheral portion of said flange means between said recess means and said terminal edge is free to be displaced axially outwardly of said open end of said container body to stress the material of said cover at said line of weakness in the direction radially inwardly of said cover from said peripheral portion of said flange means, said recess means providing for the material of said cover to rupture at said line of weakness in response to said axially outward displacement and under a force of displacement less than that required to release said cover from said container body.

28. The container assembly according to claim 27, wherein said recess means is generally centrally located with respect to said inner and outer edges of said radially extending flange portion.

29. The container assembly according to claim 28, wherein said recess means is a peripherally continuous V-shaped recess.

30. The container assembly according to claim 29, wherein said V-shaped recess has an angle of 60° between the converging sides thereof.

31. The container assembly according to claim 27, wherein said recess means is a peripherally continuous V-shaped recess in which the root line of the V is circular and coaxial with said open end of said container body and located generally centrally between said inner and outer edges of said radial flange.

* * * * *